US005970962A

United States Patent [19]

Nelson et al.

[11] Patent Number: 5,970,962

[45] Date of Patent: Oct. 26, 1999

[54] PCV HEATER AND METHOD FOR MANUFACTURING SAME

[75] Inventors: Kirk A. Nelson, Invergrove Heights; Brian E. Wicks, Edina; Gary C. Edwards, Apple Valley, all of Minn.

[73] Assignee: Phillips & Temro Industries Inc., Eden Prairie, Minn.

[21] Appl. No.: 09/044,723

[22] Filed: Mar. 19, 1998

[51] Int. Cl.[6] ..... F02M 25/06

[52] U.S. Cl. ..... 123/573; 123/572; 123/574; 219/206

[58] Field of Search ..... 123/572, 573, 123/574; 392/319, 397; 219/206, 207

[56] References Cited

U.S. PATENT DOCUMENTS

| | | | |
|---|---|---|---|
| 3,088,447 | 5/1963 | Henderson . | |
| 4,279,236 | 7/1981 | Dallman . | |
| 4,361,125 | 11/1982 | Igashira et al. . | |
| 4,390,000 | 6/1983 | Igashira et al. . | |
| 4,395,994 | 8/1983 | Goto et al. . | |
| 4,404,950 | 9/1983 | Dallman . | |
| 4,407,254 | 10/1983 | Kato et al. . | |
| 4,416,242 | 11/1983 | Kato et al. | 123/549 |
| 4,489,232 | 12/1984 | Wada et al. . | |
| 4,651,702 | 3/1987 | Nara et al. | 123/549 |
| 4,768,493 | 9/1988 | Ohtaka et al. . | |
| 5,024,203 | 6/1991 | Hill . | |
| 5,329,913 | 7/1994 | Suzuki et al. . | |
| 5,401,935 | 3/1995 | Smith et al. | 219/206 |

FOREIGN PATENT DOCUMENTS

| | | |
|---|---|---|
| 2432782 | 1/1976 | Germany . |

*Primary Examiner*—Noah P. Kamen
*Assistant Examiner*—Hai Huynh
*Attorney, Agent, or Firm*—Harness, Dickey & Pierce, P.L.C.

[57] ABSTRACT

A PCV heater including a plug and a heat sink coupled to the plug. The plug and the heat sink define a gas flow path having a first end and a second end. The second end of the gas flow path defines a discharge port and the heat sink is proximate to the discharge port. The heater also includes a heating element coupled to the plug and electrically connectable to a power source. The heating element thermally engages the heat sink to communicate heat from the heating element to the heat sink when the heating element is electrically connected to the power source. A method for manufacturing the PCV heater includes the steps of placing a heat sink into a mold cavity, coupling a heating element to the heat sink, electrically connecting a first lead wire and a second lead wire to the heating element, and providing a high temperature plastic to the mold cavity to overmold the heat sink and the heating element.

21 Claims, 4 Drawing Sheets

PCV HEATER AND METHOD FOR MANUFACTURING SAME

BACKGROUND OF THE INVENTION

1. Technical Field

The present invention relates generally to an electric heater for an internal combustion engine and, more particularly, to an electric heater for a positive crankcase ventilation system of an internal combustion engine.

2. Discussion

Positive crankcase ventilation (PCV) draws and feeds gases from the engine crankcase into the engine induction system such as at the intake manifold. Crankcase gases oftentimes include a fairly high percentage of unwanted constituents, such as hydrocarbons, resulting from blowby during engine operation. These unwanted constituents may be burned off after recirculation through the PCV system. A PCV valve normally positioned proximate to the crankcase regulates the flow through the PCV system into the intake manifold in relation to the engine load.

During cold weather operation of the engine, condensation problems can result in the area where the PCV system discharges gases into the intake manifold. More particularly, ambient air drawn into and through the air intake system during operation of the engine mixes with the PCV gases that have been warmed through combustion. Condensation occurs as the PCV gases cool in the mixing zone. If the ambient temperatures are sufficiently cold, the condensed liquid may freeze causing plugging of the PCV system and over-pressures in the crankcase that ultimately may prevent proper engine operation.

Previous PCV heaters have failed to adequately address these freeze-up concerns. More particularly, a presently used PCV heater includes a stamped steel fitting having a steel cup integral with a steel tube. The steel cup is configured to be coupled to an appropriately sized opening in the intake manifold and the steel tube is connectable to a conduit that conveys the ventilated gases from the PCV valve to the fitting. In this device, the tube is heated by a resistance element that is wound about the base of the tube. The resistance element is generally turned twice about the tube and crossed over itself in close proximity to a previous turn. The conductive nature of the cup and tube as well as the proximity of the wires create an undesirably large frequency of shorting.

In heaters having a wrapped resistance wire as the heating element, design concerns specifically related to space constraints, heating capacity, power usage, and short circuiting must be balanced. In general, it would be desirable to optimize the number of wire turns to control the heating capacity of the unit. However, space constraints limit the number of turns that may be used without incurring an unacceptably high frequency or probability of shorting. A smaller diameter wire could be used to decrease the number of turns and improve on shorting. However, when smaller diameter wires are used, the total length of wire is shortened and the operating temperature within the wire is increased leading to a decrease in robustness and service life.

In addition to the above-described operational concerns, the previous heater is difficult to manufacture. More particularly, manufacture requires termination of the resistance wire to lead wires communicating with a power source, manually wrapping wires about the tube, over-potting the wrapped wires with a heat transfer epoxy, allowing the potting epoxy to cure for 30 to 45 minutes, covering the helically wound resistance element with a silicon epoxy to limit electrical conductivity and heat transfer away from the tube, and oven curing the silicon epoxy for 60 minutes. Oftentimes shorting concerns require dipping of the resistance wires in a soft cure heat transfer epoxy prior to wrapping. The epoxy is then cured for approximately thirty (30) to forty-five (45) minutes. This labor intensive and time consuming procedure increases manufacturing costs and limits the capacity of manufacture.

In view of the above, a need exists for an improved PCV heater. Improved PCV heaters would advantageously address each of the above concerns including a reduced frequency of shorting, more simplified and inexpensive manufacturing procedures, concentrate the heat in the area of freeze-up, thermally isolate the heat sink of the heater from the engine, and generate a given amount of heat with better efficiency thereby lowering required wattages and saving energy.

SUMMARY OF THE INVENTION

Accordingly, the present invention relates generally to a PCV heater that addresses freeze-up concerns in a PCV system. More particularly, the PCV heater includes a plug and a heat sink coupled to the plug. The plug and the heat sink define a gas flow path having a first end and a second end. The second end of the gas flow path defines a discharge port and the heat sink is proximate to the discharge port. The heater also includes a heating element coupled to the plug and electrically connectable to a power source. The heating element thermally engages the heat sink to communicate heat thereto when the heating element is electrically connected to the power source. A method for manufacturing the PCV heater includes the steps of placing a heat sink into a mold cavity, coupling a heating element to the heat sink, electrically connecting a first lead wire and a second lead wire to the heating element, and providing a high temperature plastic to the mold cavity to overmold the heat sink and the heating element.

BRIEF DESCRIPTION OF THE DRAWINGS

Other objects and advantages of the invention will become apparent to one skilled in the art upon reading the following specification and subjoined claims and upon reference to the drawings in which:

DETAILED DESCRIPTION

Several embodiments of the present invention will now be described with reference to FIGS. 1–8. An exemplary method for forming the various embodiments of the present invention will then be described with reference to FIGS. 9 and 10. It should be understood that while the PCV heater and accompanying components are illustrated and described in a specific location on the illustrated engine, various alternate locations may be used without departing from the scope of the invention as defined by the appended claims. Those skilled in the art will appreciate that each embodiment of the PCV heater is positionable proximate to the area or zone where the cold ambient air mixes with the gases in the PCV system as hereinafter described. Those skilled in the art will further appreciate from the following description that the PCV heater of the present invention provides numerous advantages over the prior art including the use of a heat sink to concentrate heat at the discharge port of the heater to achieve improved resistance to freeze-up at reduced watt density, lower energy consumption, and cooler heating element operating temperatures. These and other advantages of the present invention are described above as well as in this detailed description.

Figure 1:
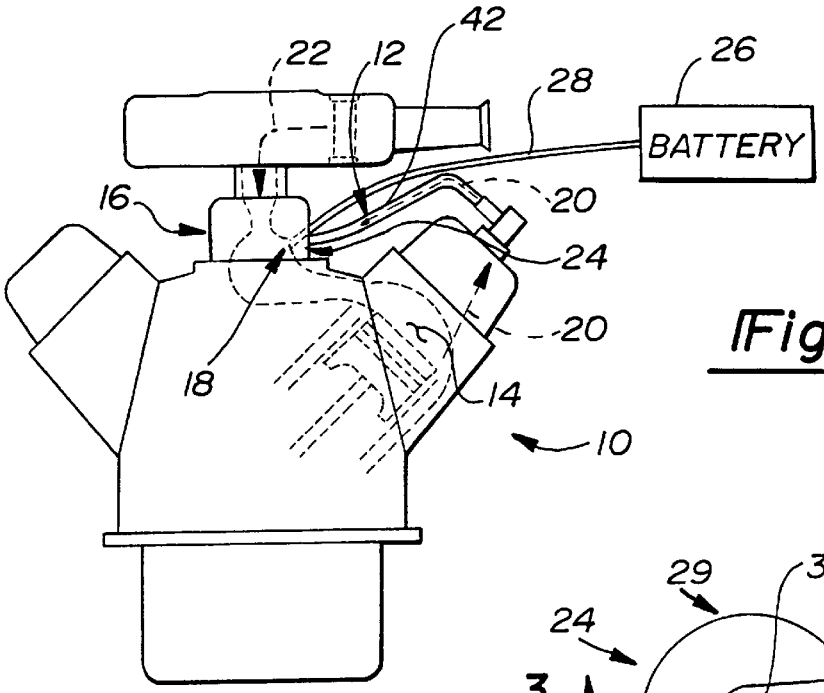
FIG. 1 is an elevational view of an internal combustion engine having a PCV system.

An engine 10 is illustrated in FIG. 1 to include a PCV system 12 in communication with a combustion chamber 14 and intake manifold 16. The general location and operation of PCV systems are generally known in the art. Reference may be made to U.S. Pat. No. 4,768,493 issued Sep. 6, 1988 to Ohtaka et al., the disclosure of which is hereby incorporated by reference, for a more complete description of such systems. A mixing zone generally indicated by reference numeral 18 is formed generally at intake manifold 16 and, more particularly, in the proximity of the confluence of the recirculated gases indicated by flow arrows 20 and the ambient air indicated by flow arrow 22. PCV heater 24 includes an electric heater element that is connected to a power source such as battery 26 via a lead wire harness 28. Heater 24 is positioned at or slightly upstream of mixing zone 18 along circulated gas flow path 20 to prevent freezing of the condensed moisture in this area and thereby reduce the probability of plugging of the PCV system and the resulting over-pressures in the crankcase.

The illustrated position of the PCV heater 24 relative to intake manifold 16 is provided for exemplary purposes. Those skilled in the art will appreciate that heater 24 is preferably positioned at the PCV system discharge point corresponding to the air inlet for the engine intake in order to provide proper PCV gas mixing and conveyance to all engine cylinders. This air inlet may include the illustrated intake manifold as well as other generally recognized alternatives such as the throttle body or carburetor.

Figure 2:
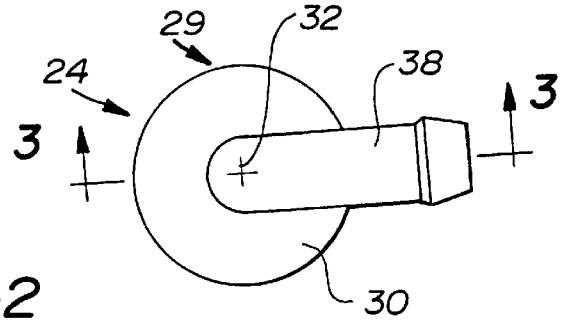
FIG. 2 is a top plan view of a PCV fitting according to the present invention.
Figure 3:
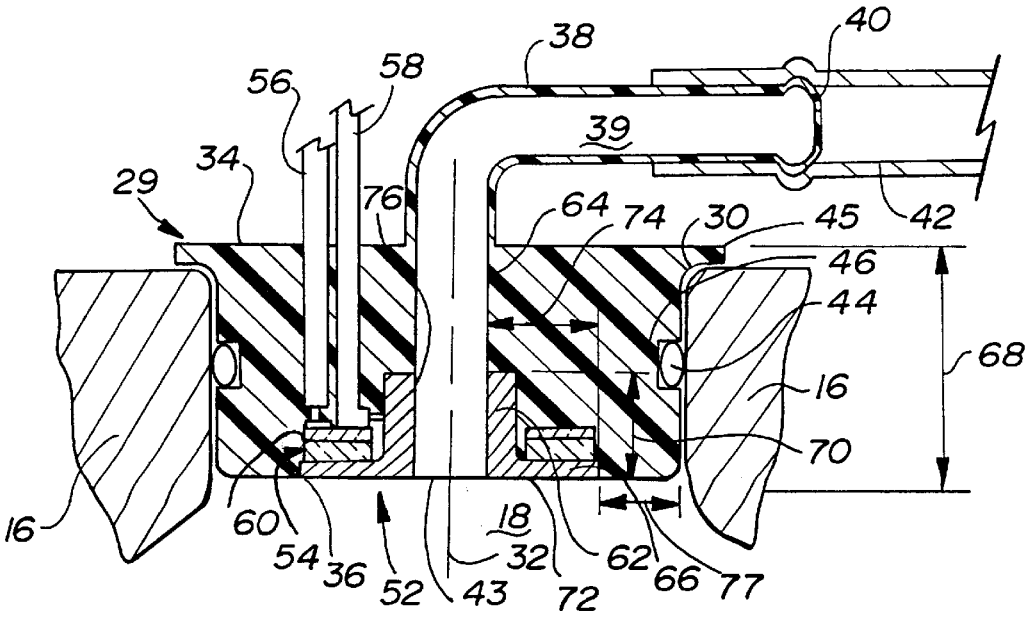
FIG. 3 is a sectional view taken along the line 3—3 of FIG. 2 illustrating a first embodiment of the PCV heater.

The structure and operation of various embodiments of a PCV heater according to the present invention will now be described in detail with reference to FIGS. 2–8. As shown in FIGS. 2 and 3, PCV heater 24 includes a fitting 29 having a plug 30 that is generally cylindrical about an axis 32 and that includes an upper end 34 and a lower end 36. Fitting 29 also includes a flow tube 38 extending from plug 30. The plug, flow tube, and a heat sink 52 define a flow passage 39 extending from a first tube end 40 to a discharge port 43 (FIG. 3). As illustrated in FIGS. 1 and 3, a PCV conduit 42 is connectable to the first tube end 40 for communicating circulated gas flow from the combustion chamber through passage 39 and into intake manifold 16 at the discharge port 43.

In the embodiment illustrated in FIGS. 2 and 3, fitting plug 30 is integral with flow tube 38 and formed of a high temperature plastic material such as a glass or mineral impregnated high temperature nylon material including Zytel or Valox manufactured by DuPont. Plug 30 also includes a stop flange 45 to engage the intake manifold 16 and prevent over insertion of PCV heater 24, as well as a sealing element such as an o-ring 44 disposed within a cooperating groove 46 formed in plug 30. In the illustrated embodiment, the press-fit engagement of the heater plug 30 with intake manifold 16 securely connects the PCV heater 24 to the intake manifold 16. Notwithstanding the above descriptions, those skilled in the art will appreciate that a variety of sealing assemblies and locking elements, such as the use of a retaining clip, may be used with the present invention without departing from the scope thereof as defined by the appended claims. Moreover, a snap or press fit engagement between the PCV heater plug 30 and intake manifold 16 may provide sufficient sealing to eliminate the need for the o-ring and groove configuration illustrated in FIG. 3.

With continued reference to FIGS. 2 and 3, PCV heater 24 includes a heating element 54 coupled to plug 30 in a thermally conductive relationship with heat sink 52. The heating element 54 in this embodiment of the invention is a ring-shaped positive temperature coefficient (PTC) ceramic element that is electrically connected to first and second lead wires 56 and 58. Specifically, a positive polarity 12-volt direct current terminal plate 60, also ring-shaped, is in contacting engagement with heating element 54 and is electrically connected to first lead wire 56. Heating element 54 is also electrically connected to heat sink 52 which in turn is electrically connected to second lead wire 58. By this arrangement, heat sink 52 functions as a negative 12-volt direct current terminal plate for completing the electric circuit between lead wires 56 and 58. It should be appreciated that numerous techniques are generally known in the art to electrically connect lead wires 56 and 58 to terminal plate 60 and heat sink 52 as well as for connecting the respective lead wires to the battery 26 via harness 28 (FIG. 1). Moreover, those skilled in the art will appreciate that heat sink 52, heating element 54, and terminal plate 60 may be coupled to one another by an electrically conductive adhesive, by a mechanical connector (such as that illustrated in FIGS. 9 and 10 and hereafter described), or by other materials or methods generally known in the art.

As illustrated in FIG. 3, heat sink 52 includes a sleeve 62 integral with an annular flange 66. Sleeve 62 is generally cylindrical in shape and extends from the lower end 36 of plug 30 along axis 32 to partially define flow tube 38. Annular flange 66 extends from sleeve 62 and partially defines the lower end 36 of plug 30.

Figure 4:
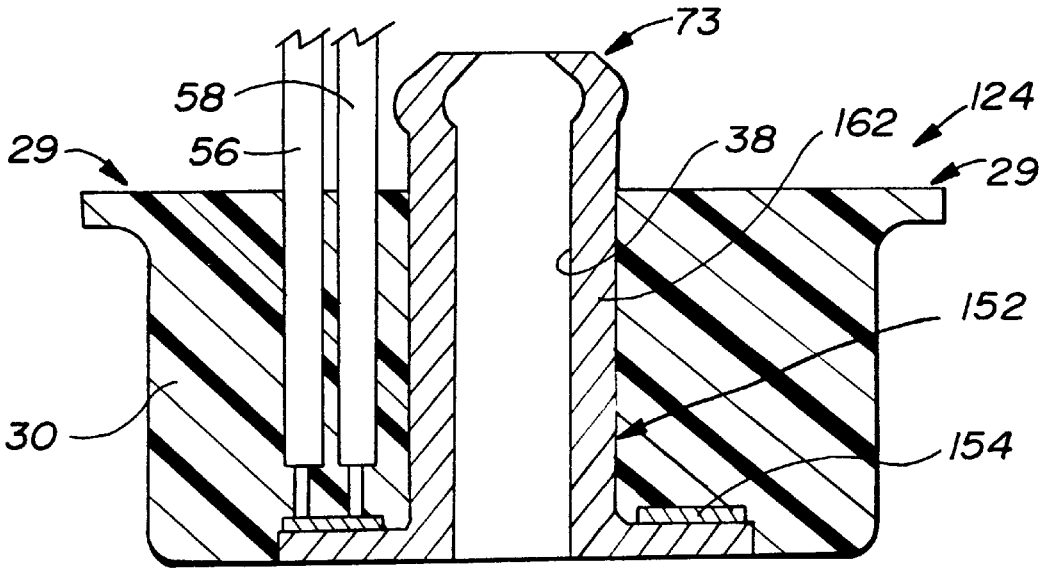
FIG. 4 is a sectional view similar to that shown in FIG. 3 but illustrating a second embodiment of the PCV heater.
Figure 9:
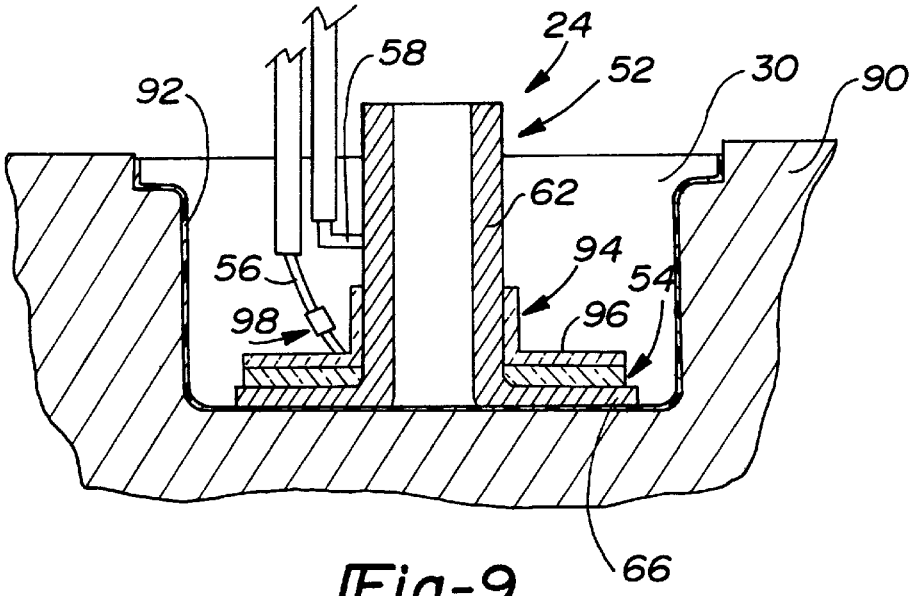
FIG. 9 is a sectional view of a PCV heater and mold for forming the plug about the heat sink, mechanical connector, and heating element illustrated in FIG. 10.

Various design considerations dictate the specific size and configuration of heat sink 52. More particularly, the configuration of the heat sink may be modified to concentrate or direct heat to a greater or lesser extent along gas flow path 39 and lower end 36 of plug 30 as needed. Physical constraints such as the thickness, material properties, and configuration of the heating element as well as the thickness of any terminal plate 60 will also impact the configuration of heat sink 52. In the preferred embodiment, the height 68 of plug 30 is approximately 13 millimeters while the length 70 of sleeve 62 measured from an annular surface 72 of flange 66 is approximately 6–15 mm. By this description of the relative sizes of the plug 30 and sleeve 62, it should be apparent to one skilled in the art that sleeve 62 may extend beyond upper surface 34 of plug 30 (FIGS. 4 and 9)

whereupon the conduit 42 may be directly connected to heat sink 52. Those skilled in the art will appreciate that the configuration of sleeve 62, when extending beyond upper end 34, may be modified to define a tube connection 73 (FIG. 4) for sliding, snap fit, or press fit engagement with conduit 42. Flange 66 extends radially from an axial surface 76 of sleeve 62 a distance 74 that is selected based upon the desired heating characteristics of heat sink 52. It is desirable to limit distance 74 and maximize an insulating distance 77 so that the insulating distance 77 of plug 30 is sufficient to prevent shorting of the circuit to manifold 16 as well as to maintain sufficient thermal insulation between the heat sink and manifold. In the illustrated embodiment, distance 77 is on the order of about at least 1 to 2 mm.

Those skilled in the art will appreciate that the relative dimensions of height 68, length 70, radial extension 74, and distance 77 may vary based upon the specific application of PCV heater 24, the composition of heating element 54, and the electrical and thermal conductive capabilities of heat sink 52. While it is generally desirable to make the PCV heater 24 and its components as large as possible for structural integrity and manufacturing ease, space constraints dictate that relatively small components are necessary. The above-described configuration beneficially concentrates heat at the lower end 36 of plug 30 in the proximity of discharge port 43 thereby maximizing the effectiveness of the PCV heater in preventing freeze-up of the flow tube as well as increasing the efficiency of the PCV heater by reducing the watt density necessary to achieve appropriate heating, saving energy, allowing the heating element to operate at cooler temperatures, and increasing reliability such as by maximizing the service life of the heating element 54.

The PTC ceramic heating element 54 illustrated in FIG. 3 and generally described above has operational characteristics that are generally known in the art. Exemplary PTC ceramic heating elements include those manufactured by Texas Instruments of Attleboro, Me. or Control Devices of Standish, Me. PTC heating elements generally provide a self-regulating resistance in that as the temperature of the PTC heater element is increased, its resistance also increases to provide a generally constant temperature heating element. A particular PTC heating element may be selected to provide the desired temperature and heat conveyance proximate to discharge port 43.

When a PTC heating element is used, thermostatic control of the current to the heating element may not be necessary. Should a thermostat be desirable for this or other embodiments of this invention, a thermostat (not shown) may be included with PCV heater 24 or interdisposed within the electric circuit between PCV heater 24 and battery 26 in a manner generally known in the art. Those skilled in the art will further appreciate that the thermostat may be located in a variety of positions both proximate to and remote from fitting 29 without departing from the scope of the invention as defined by the appended claims. A variety of thermostats capable of regulating the current flow to the PCV heater based upon an appropriate temperature parameter are generally known in the art. A further characteristic of the PCV heaters is that they are intended to operate only during engine operation in a manner controllable through a switch mechanism (not shown) for interrupting current flow. Such switch mechanisms are also generally known in the art.

Heat sink 52 is preferably cast, stamped, or formed of a material having a relatively high thermal conductivity, greater than about 60 BTU/hour·ft$^2$·° F.·ft. Specifically, heat sink 52 is preferably formed of an aluminum, copper, or brass having the above thermal conductivity as well as a relatively low electrical resistivity, generally on the order of less than about 40 ohms (mil:ft), to communicate current from terminal plate 60 to lead wire 58.

For completeness, the operation of the heater 24 illustrated in FIG. 3 will now be described. During engine operation current flows between lead wires 56 and 58 and through PTC ceramic heating element 54 whereupon the electrical resistance of the heating element causes an increase in the temperature thereof. Current flowing through the heating element 54 is communicated to the lead wires via the electrically conductive heat sink 52. As heating element 54 increases in temperature, heat is communicated to heat sink 52 thereby heating the gas flow passage 39 proximate to discharge port 43 as well as the area proximate to lower plug end 36. The heated flow passage and lower end 36 inhibit condensation and freeze-up within or about the discharge port 43 of flow tube 38.

The above-recited structure and operation of PCV heater 24 provides numerous advantages over the prior art including the concentration of the heat generated by heating element 54 in an area most susceptible to freeze-up. The structure and configuration of the heating element, heat sink, and accompanying electric conductors allows reduced watt density for operation, better efficiency, energy savings, cooler operating temperatures for the heating element, and greater overall reliability of the PCV heater. The present invention also eliminates many of the manufacturing costs associated with prior art heaters as well as structural constraints such as resistance wire proximity in helical coils and wire cross-over that may lead to undesirable short circuiting of prior art heaters.

Turning now to the further embodiments of the present invention illustrated in FIGS. 4–8, the structural configuration of PCV heaters 124, 224, and 324 in these embodiments are generally similar to that described above with the exceptions of the structural configuration and material characteristics of the heating element, heat sink, and the electrical interconnection of these elements to lead wires 56 and 58. In view of the general similarities, common reference numerals are used to refer to similar components. In general, as will be described in detail hereinafter, the second embodiment of the PCV heater illustrated in FIGS. 4 and 5 includes a thin film heating element 154. The third embodiment of the present invention illustrated in FIGS. 6 and 7 includes a heating element 254 having a resistance wire 286 helically wound about a donut-shaped support ring 288 and electrically connected to lead wires 56 and 58. Finally, the fourth embodiment of the present invention (FIG. 8) includes a resistance wire heating element 354 coupled to and in thermal relationship with a heat sink 352 which includes a spool 363 formed on sleeve 362.

Figure 5:
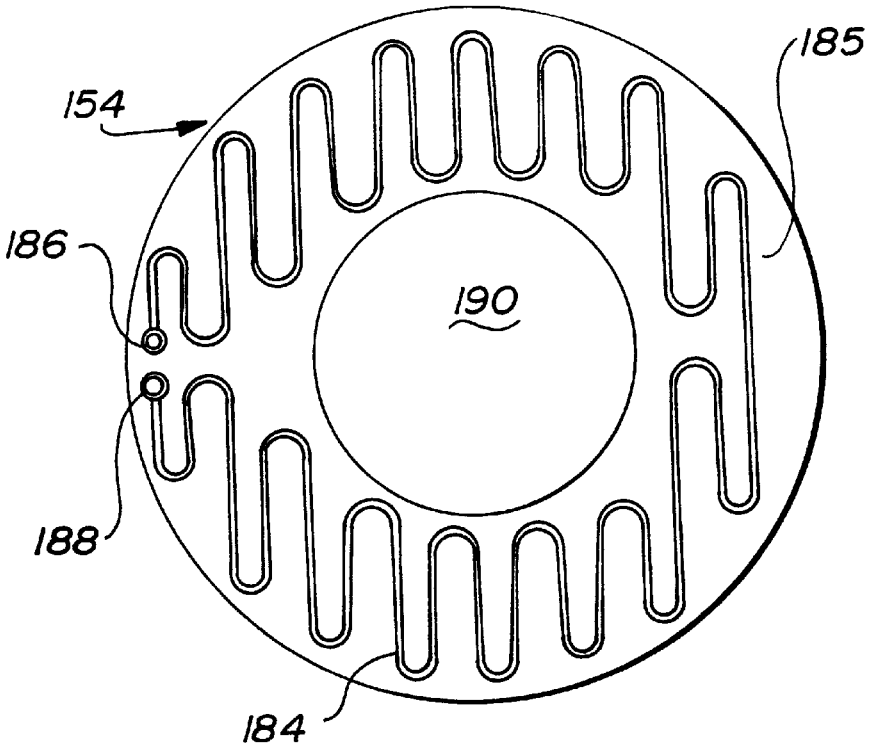
FIG. 5 is a top plan of the heating element shown in FIG. 4.

Turning now to the embodiment of the PCV heater 124 illustrated in FIGS. 4 and 5, this embodiment includes a thin film heating element 154 coupled to a heat sink 152 and electrically connected to lead wires 56 and 58. As best illustrated in FIG. 5, thin film heating element 154 includes a resistance element 184 having terminal ends 186 and 188 electrically connectable to lead wires 56 and 58, respectively, in a manner known in the art. Those skilled in the art will appreciate that the structure and operation of thin film heating element 154 is generally known in the art and that the resistance element 184 thereof may include a resistance wire, conductive and resistive etching, or equivalent heat generating element contained within an insulator 185. For example, a thin film heating element such as the flat foil heating elements manufactured by Minco of Minneapolis, Minn. under the trade name Thermalfoil™ may be used with the present invention. As best illustrated in FIG. 5, the thin film heating element 154 is generally ring shaped to define a centered aperture 190 disposable about sleeve 162 of heat sink 152. Those skilled in the art should also appreciate that various materials may be used to isolate the resistance element 184 of thin film heating element 154 including nonconductive materials such as mica.

While resistance element 184 of thin film heating element 154 is generally sufficiently electrically insulated by insulator 185, additional protection from shorting may be achieved by anodizing the heat sink material as hereinafter described. The anodized heat sink is electrically passive thereby further insulating the current flowing within resistance element 184 from conductive elements of the engine surrounding PCV heater 124 while maintaining the desired thermal conductivity. Those skilled in the art will appreciate that the configuration and composition, including the electrical resistivity and heat conductivity, of heat sink 152 may vary for specific applications of the heater.

Figure 6:
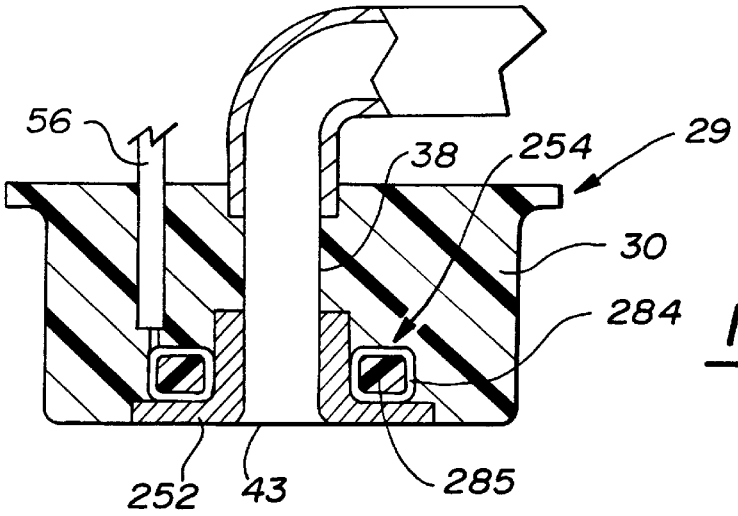
FIG. 6 is a sectional view similar to that shown in FIG. 3 but illustrating a third embodiment of the PCV heater.
Figure 7:
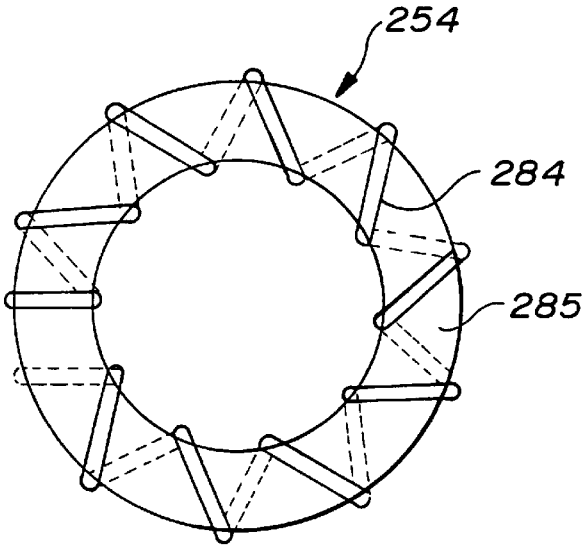
FIG. 7 is an enlarged top plan view of the heating element illustrated in FIG. 6.

Another alternate embodiment of the invention is illustrated in FIGS. 6 and 7 to include a PCV heater 224 that is similar to the above-described PCV heaters 24 and 124. More particularly, the configuration and composition of the fitting 29 is substantially the same as that described above and the heat sink 252 is preferably formed of the above-described anodized aluminum material or similar material. The anodizing of the heat sink material may be performed in a manner known in the art to create an insulative film that electrically isolates the heat sink from the conductive heating element 254. It is preferred that, when an electrically passive heat sink is desired, the anodized heat sink 152 is sufficient to pass a 600 volt dielectric test while maintaining the thermal conductivity greater than about 60 BTU/hour·ft$^{2}$·° F.·ft.

Heating element 254 illustrated in FIGS. 6 and 7 includes a resistance wire 284 helically wrapped about a support ring 285. Resistance wire 284 includes terminal ends 286 and 288 that are electrically connected to lead wires 56 and 58, respectively. By this description and the accompanying illustrations, those skilled in the art will appreciate that heating element 254 is generally a toroid shaped element wherein the size of the resistance wire 184 is selected to provide the desired resistivity, current capacity, and heat generation while satisfying the size constraints and short circuiting concerns discussed above. Those skilled in the art will further appreciate that it is generally desirable to use a resistance wire element 184 that is as large in diameter as possible for ease of manufacture and increased cross-sectional surface area.

When current from lead wires 56 and 58 is passed through resistance element 284, the element is heated. Resistance element 184 is in thermal communication with heat sink 252. The heat generated by resistance element 184 is conveyed to heat sink 252 to reduce freeze-up at and proximate to the discharge port 43. By forming heat sink 252 of the anodized material, the heat sink is electrically passive thereby preventing shorting of the resistance wire 284. The plastic plug 30 further insulates the current flowing in heating element 254 from the conductive elements of the engine surrounding PCV heater 224.

Figure 8:
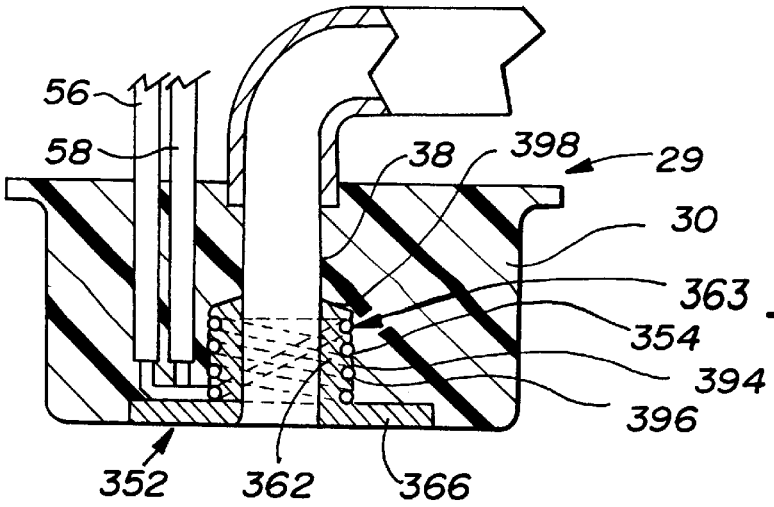
FIG. 8 is a sectional view similar to that shown in FIG. 3 but illustrating a fourth embodiment of the PCV fitting and heating element.

Another embodiment of a PCV heater 324 according to the present invention is illustrated in FIG. 8 to include a fitting 29 having a configuration and composition substantially the same as that described above. In this embodiment, heating element 354 is a resistance wire electrically connected to lead wires 56 and 58 and helically wrapped about the spool 363 formed by sleeve 362 of heat sink 352. More particularly, an outer surface 394 of sleeve 362 includes a helical groove 396 extending from an upper surface 398 of sleeve 362 and terminating proximate to flange 366. Resistance wire 354 extends from first lead wire 56 to the upper portion of the helical groove and is wrapped about the sleeve, disposed within the groove 396, and is coupled to second lead wire 58 proximate to flange 366. Those skilled in the art will appreciate that as current is passed through resistance wire 354, the wire is heated, the heat is transferred to heat sink 352 and directed via the heat sink to the areas proximate to discharge port 43.

In order to minimize the probability of shorting in the embodiment illustrated in FIG. 8, heat sink 352 is again preferably formed of an anodized aluminum material to achieve the desired heat transfer capabilities as well as resistance to current flow therethrough. More particularly, in the preferred embodiment, the anodized aluminum heat sink isolates the resistance wires while maintaining a thermal conductivity greater than about 60 BTU/hour·ft$^{2}$·° F.·ft.

From the foregoing description and the attached claims and drawings, those skilled in the art will appreciate that the various embodiments of the present invention illustrated and described provide a PCV heater having numerous advantages over the prior art. More particularly, the PCV heater of the present invention advantageously reduces the probability of shorting during operation, provides a heater design that is more simple and inexpensive to manufacture and that includes a heating element and heat sink that concentrates the heat in the area of freeze-up. Accordingly, the present invention generates heat to minimize freeze-up with better efficiency and lower required wattages than prior art devices. Corresponding manufacturing cost savings and energy savings during operation are particularly advantageous in view of the operational benefits provided by the invention.

Figure 10:
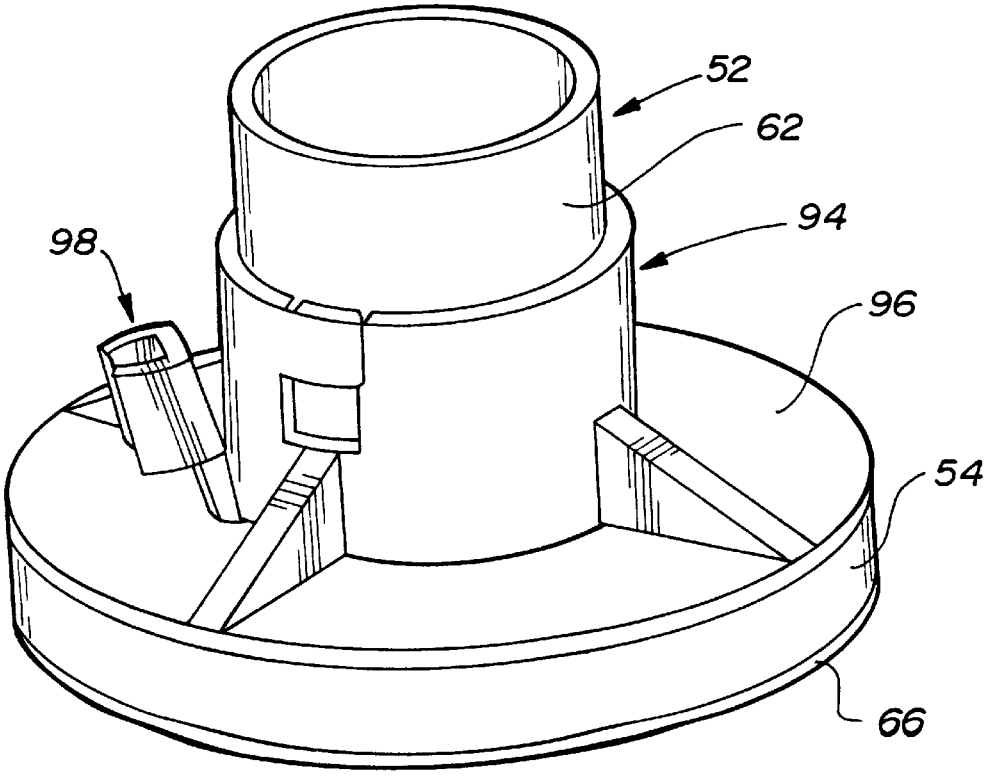
FIG. 10 is a perspective view of a mechanical connector for positioning the heating element relative to the heat sink.

With specific reference to FIGS. 9 and 10, a method of manufacturing the above-described PCV heaters 24, 124, 224, and 324 will be described. While this method will be described with specific reference to PCV heater 24 having PTC ceramic heating element 54, such as that described with reference to FIGS. 2 and 3, those skilled in the art should appreciate that the method is equally applicable to the other described embodiments.

The assembly of heater 24 includes disposing heat sink 52 within a properly configured mold 90 defining a mold cavity 92. After heat sink 52 is properly positioned within mold cavity 92, an appropriately sized PTC ceramic heating element 54 is placed upon heat sink flange 66 in the manner shown in FIGS. 9 and 10. A mechanical fastener 94, having a flange 96 functioning as terminal plate 60 (FIG. 3), is disposed in electrical engagement with heating element 54 and mechanically coupled to sleeve 62 in a manner generally known in the art. Mechanical fastener 94 preferably also includes a lead wire connector 98 for coupling lead wire 56 to flange 96 (i.e. terminal plate 60 of FIG. 3). Second lead wire 58 is coupled to sleeve 62 in a manner generally known in the art as illustrated in FIGS. 3 and 9.

After the heat sink 52, heating element 54, mechanical fastener 94, and lead wires 56 and 58 are connected in the manner illustrated and described, a high temperature plastic material is placed into the mold cavity to form plug 30. Those skilled in the art will appreciate that the mechanical fastening of fastener 94 to heat sink 52 secures the position of heating element 54 relative to heat sink 52 for the overmolding of plastic material. After the molding process is complete, the overmolded plastic assists in maintaining the structural integrity of heater 24. Those skilled in the art will also appreciate that while the above method of manufacture is illustrated and described as including mechanical fastener 94, other materials such as adhesives may be used to secure the heating element relative to the heat sink without departing from the scope of the invention as defined by the appended claims. It is contemplated that use of adhesives may be particularly appropriate for the heater embodiments illustrated in FIGS. 4–7 where a terminal plate such as that illustrated in FIG. 3 is not used.

Various other advantages will become apparent to those skilled in the art after having the benefit of studying the foregoing text and the appended drawings, taken in construction with the following claims:

What is claimed is:

1. A positive crankcase ventilation heater disposable in an intake manifold for heating a surface communicating with a mixing zone where recirculated gases mix with ambient air, comprising:

a body including a first end face, a second end face, a sidewall extending between said first and second end faces, and a gas flow path extending through said body to define a discharge port at said second end face, said body having a heat conducting portion extending along said second end face from said discharge port toward said sidewall to define an outer conducting end and an insulating portion disposed between said outer conducting end and said sidewall; and a heating element coupled to said body and being electrically connectable to a power source, said heating element thermally engaging said heat conducting portion to communicate heat from said heating element to said heat conducting portion when said heating element is electrically connected to said power source whereby said heater reduces freezing of condensation along said second end face of said body.

2. The heater of claim 1 wherein said body includes a plug defining said insulating portion and a heat sink defining said heat conducting portion, wherein said heat sink includes a sleeve defining said discharge port and a flange integral with said sleeve, said flange extending radially from said sleeve and including a radially outer surface defining said outer conducting end and an annular surface defining said second end face of said body.

3. The heater of claim 2 wherein said heat sink extends from said first end face to said second end face to define said gas flow path.

4. The heater of claim 2 wherein said sleeve includes a spool with a helical depression and wherein said heating element is a wire disposed in said helical depression.

5. The heater of claim 1 wherein said plug is formed of a high temperature plastic.

6. The heater of claim 1 wherein said heat sink is formed of a material having a heat conductivity of at least about 60 BTU/hour·ft$^2$·° F.·ft and an electrical resistivity of less than about 40 ohms (mil:ft).

7. The heater of claim 6 wherein said material is aluminum.

8. The heater of claim 6 wherein said material is an anodized aluminum.

9. The heater of claim 1 wherein said heating element is a positive temperature coefficient ceramic.

10. The heater of claim 1 wherein said heating element is a thin film.

11. The heater of claim 1 wherein said heating element includes a support ring and a resistance wire helically wrapped about said ring.

12. In an internal combustion engine having a crankcase, an intake manifold, and a positive crankcase ventilation system for selectively circulating gases from the crankcase to the intake manifold, said circulated gases being mixed with ambient air in a mixing zone, said positive crankcase ventilation system including a heater coupled to said engine proximate to said mixing zone, said heater comprising:

a body including a first end face, a second end face, a sidewall extending between said first and second end faces, and a gas flow path extending through said body to define a discharge port at said second end face, said body having a heat conducting portion extending along said second end face from said discharge port toward said sidewall to define an outer conducting end and an said insulating portion disposed between said outer conducting end and said sidewall; and a heating element coupled to said body and being electrically connectable to a power source, said heating element thermally engaging said heat conducting portion to communicate heat from said heating element to said heat conducting portion when said heating element is electrically connected to said power source.

13. The heater of claim 12 wherein said heating element is a positive temperature coefficient ceramic.

14. The heater of claim 12 wherein said heating element is a thin film.

15. The heater of claim 12 wherein said heating element includes a support ring and a resistance wire helically wrapped about said ring.

16. The heater of claim 12 wherein said body includes a plug defining said insulating portion and a heat sink defining said heat conducting portion, wherein said heat sink includes a sleeve defining said discharge port and a flange integral with said sleeve, said flange extending radially from said sleeve and including a radially outer surface defining said outer conducting end and an annular surface defining said second end face of said body.

17. The heater of claim 16 wherein said heat sink includes a sleeve having a spool with a helical depression and wherein said heating element is a wire disposed in said helical depression.

18. The heater of claim 16 wherein said plug is formed of a high temperature plastic that thermally isolates said heat sink from said manifold.

19. An internal combustion engine comprising:

a crackcase;

an intake manifold having a mixing zone;

a positive crankcase ventilation system communicating with said crankcase and said intake manifold to circulate gases from the crankcase to said mixing zone, said positive crankcase ventilation system including a heater having a body with a first end face, second end face, a sidewall extending between said first and second end faces, and a gas flow path extending through said body to define a discharge port at said second end face, said discharge port communicating with said mixing zone, said body having a heat conducting portion extending along said second end face from said discharge port toward said sidewall to define an outer conducting end and an insulating portion disposed between said outer conducting end and said sidewall; and a heating element coupled to said plug body and being electrically connectable to a power source, said heating element thermally engaging said heat conducting portion to communicate heat from said heating element to said heat conducting portion when said heating element is electrically connected to said power source.

20. The heater of claim 19 wherein said body includes a plug defining said insulating portion and a heat sink defining said heat conducting portion, wherein said heat sink includes a sleeve defining said discharge port and a flange integral with said sleeve, said flange extending radially from said sleeve and including a radially outer surface defining said outer conducting end and an annular surface defining said second end face of said body.

21. The heater of claim 20 wherein said heat sink extends from said first end face to said second end face to define said gas flow path.

* * * * *

UNITED STATES PATENT AND TRADEMARK OFFICE

CERTIFICATE OF CORRECTION

PATENT NO. : 5,970,962
DATED : October 26, 1999
INVENTOR(S) : Kirk A. Nelson, et al.

It is certified that error appears in the above-identified patent and that said Letters Patent is hereby corrected as shown below:

On the Title Page, under [56] References Cited, U.S. PATENT DOCUMENTS, after "4,768,493 9/1988 Ohtaka et al", insert new line --4,870,249 9/1989 Kayanuma et al--.

Col. 9, lines 14 and 15, "construction" should be --conjunction--.*

Col. 10, line 46, "crackase;" should be --crankcase;--.*

Signed and Sealed this

Twenty-sixth Day of December, 2000

*Attest:*

Q. TODD DICKINSON

*Attesting Officer*

*Director of Patents and Trademarks*